US012604959B1

(12) United States Patent
Peters et al.

(10) Patent No.: US 12,604,959 B1
(45) Date of Patent: Apr. 21, 2026

(54) CARD WALLET

(71) Applicant: Proof Products USA, LLC, Columbus, OH (US)

(72) Inventors: Dana Peters, Dublin, OH (US); Scott Scherpenberg, Columbus, OH (US); Robert Schilling, Dublin, OH (US); Chet Peters, Dublin, OH (US)

(73) Assignee: Proof Products USA, LLC, Columbus, OH (US)

( * ) Notice: Subject to any disclaimer, the term of this patent is extended or adjusted under 35 U.S.C. 154(b) by 0 days.

(21) Appl. No.: 19/020,642

(22) Filed: Jan. 14, 2025

(51) Int. Cl.
*A45C 11/18* (2006.01)

(52) U.S. Cl.
CPC ..... *A45C 11/182* (2013.01); *A45C 2011/186* (2013.01)

(58) Field of Classification Search
CPC ..... A45C 11/182; A45C 11/186
See application file for complete search history.

(56) References Cited

U.S. PATENT DOCUMENTS

| | | | | |
|---|---|---|---|---|
| 1,832,625 | A * | 11/1931 | Gardner, Jr. | A45C 1/06 150/149 |
| 8,151,981 | B2 * | 4/2012 | Nordstrom | A45C 7/0077 206/254 |
| 11,178,947 | B2 * | 11/2021 | Tran | A45C 11/182 |
| 12,336,608 | B1 * | 6/2025 | Lin | A45C 1/06 |
| 2008/0035506 | A1 * | 2/2008 | Rostami | A45C 11/00 206/320 |
| 2016/0324283 | A1 * | 11/2016 | Kane | A45C 11/182 |
| 2024/0341430 | A1 * | 10/2024 | Lin | A45C 11/182 |

* cited by examiner

*Primary Examiner* — Tri M Mai
(74) *Attorney, Agent, or Firm* — Kevin Keener; Keener and Associates P.C.

(57) ABSTRACT

The present invention is directed toward a minimalistic card wallet similarly sized to the width and length dimensions of a credit card. The card wallet is designed interchangeably with an elastic band for expansion to provide the maximal amount of compartment space for card-like contents as well as paper currency. The card wallet is formed in a minimal profile and design that is snag-free, easy to use, and comfortable in pockets. The card wallet allows for ease of access to card-like contents by a pull strap and is encased in RFID blocking materials made from beveled aluminum metal and soft leather or carbon fiber for carrying comfort and simplicity.

20 Claims, 11 Drawing Sheets

CARD WALLET

FIELD OF THE INVENTION

The current invention pertains to wallets and more specifically to a low-profile, RFID-blocking card wallet designed minimalistic with a method of expansion to hold maximal amounts of credit cards, other card stocks, and paper money.

BACKGROUND OF INVENTION

Traditional billfold wallets are known and are meant to hold paper money, identifications, and cards or credit cards. These wallets can fold and normally have pre-designed credit card slots and are generally limiting to the number of cards one can carry at any given time and also typically offer a compartment for paper money. This paper money compartment however is oftentimes also used to hold additional paper stock such as business cards, sales receipts, bank checks, notes, and coupons to name a few. This compartment can quickly become overused and contain an excess of unnecessary paper items, creating an oversized and bulky wallet that is uncomfortable to sit on in a back pocket and too large and bulged for a front pocket. Billfold wallets are also typically made from materials such as leather or other fabrics that can lose elasticity when overpacked or stretched. This can lead to cards or other items falling out of the designed holders and compartments after the unnecessary items are removed from the wallet.

Credit card wallets or card holders are becoming more popular as the inconvenience of transacting with paper money and coin is being replaced with the now common tap and pay feature with credit or debit cards. These card holder wallets are minimalistic and designed to hold very little if any paper money and generally are designed to hold anywhere between four and twelve cards. It is known that the average American carries on average four credit cards. That number however, does not include membership cards, gift cards, IDs, driver's license, insurance and prescription cards, key cards, or business cards. Thus, the number of cards required by the user may not fit into an average minimalist card holder. This could make for potential inconveniences as it would be necessary to switch cards in and out based on what cards would be required for any specific day. The possibility of forgetting to switch out any necessary cards before leaving one's residence could result in the user having to go back home to make the exchange or alter and cancel their plans or appointments altogether.

Card holders relatively newer to the market and having simple construction are commonly designed with two metal plates or fabric that sandwich the credit cards between them. To remove the cards from this style of card holder, there is commonly a notch cut out of the metal plate for a user to apply pressure to the cards. If this action is not performed carefully, the user is at risk of spilling all of the cards out unintentionally. Oftentimes, there is a money clip attached to the rear side of the card holding wallet. Over time, the sharp, square edges of the metal plates as well as the metal money clip can cause damage and create holes in the fabric of the user's jeans or pants pocket surrounding the card holder. In some instances, the card holder can get snagged on fabric and make it difficult to move the card wallet in and out of a pocket, or even worse can scratch or break the surface of the user's skin. More traditional card holding wallets are made from leather or a comparable material and similar to billfold wallets have a limited number of pre-designed slots that when over-filled with cards or credit cards can lose their elasticity possibly resulting in the loss of property.

As technology continues to evolve and simply our lives so does the technological advancement for criminals and thieves to steal information or belongings. Radio Frequency Identification (RFID) skimming uses radio waves to steal one's card information from a distance. This criminal technology may pose a serious threat in areas of high traffic such as public transportation, sporting events, and grocery stores, to name a few. This stolen information could allow thieves an avenue to steal one's identity or make fraudulent purchases.

What is needed is a credit card wallet with a minimalistic design that still holds paper currency and holds a maximal number of credit cards that may be accessed by a pull strap encased in an RFID blocking hybrid wallet made from beveled aluminum metal and soft leather or carbon fiber.

SUMMARY OF THE INVENTION

The following presents a simplified summary in order to provide a basic understanding of some aspects of the disclosed innovation. This summary is not an extensive overview, and it is not intended to identify key/critical elements or to delineate the scope thereof. Its sole purpose is to present some concepts in a simplified form as a prelude to the more detailed description that is presented later.

The present invention is directed toward a card wallet with a minimalistic profile designed with expansion to hold a maximal number of card-sized objects in a wallet configuration while still able to hold paper currency. The card wallet utilizes multiple materials forming a minimal profile that is designed for carrying comfort and simplicity.

The card wallet may form a profile comprised of a front metal plate and outer panel. The front metal plate may be removably secured to a backing plate. The front metal plate may be designed for customizability where any plate with any style or feature can be easily removed and replaced. The front metal plate may comprise a beveled edge to help prevent the card wallet from getting caught on pockets or other wallet carrying accessories. The outer panel may be removably secured to the backing plate and may be comprised of soft leather for comfortable carrying in pockets. The outer panel and front metal plate may be secured to the backing plate with flat, hexagonal driver screws that are countersunk into the outer panel and front metal plate to provide a flat, smooth frontal surface of the card wallet. There may be a felt liner attached to the inner portion of the outer panel.

The card wallet may utilize a pull tab and strap feature to easily remove card-like contents from the card wallet. A second portion of the pull strap may be fed through a slot in the felt and may be attached by any means to the inner portion of the outer panel. A first portion of the pull strap may be fed through a strap slot of the backing plate. There may be a pull tab attached by any means to the first portion of the pull strap. To access the card-like contents a user may pull the pull tab outward and all of the cards contained within the card compartment may become visible for selection. To replace the card-like contents a user may apply a downward pressure to the card-like contents and the pull tab and pull strap may slide inward. The backing plate may comprise a catch bar to reseat the pull tab and allow it to become flush again with the front metal plate.

For expandability the card wallet may have an elastic band that is interposed between the front metal plate and backing plate. The elastic band may encircle the backing plate and front metal plate. The elastic band may hold the card-like contents securely by means of compression where the introduction of additional card-like contents may increase the pressure of compression. The design and materials of the elastic band may provide more holding capacity than what is typically found in the market. On the rear side of the card wallet the elastic band and the outer panel may share an abutting surface and may provide an open compartment for holding paper currency. The front metal plate, outer panel, and backing plate may have RFID blocking capabilities.

The primary object of the invention is to provide a minimalistic card wallet similarly sized to the width and length dimensions of a credit card and still provide the maximal amount of compartment space for card-like contents and paper currency in a design that is snag-free, easy to use, and comfortable in pockets.

Still other embodiments of the present invention will become readily apparent to those skilled in this art from the following description wherein there is shown and described the embodiments of this invention, simply by way of illustration of the best modes suited to carry out the invention. As it will be realized, the invention is capable of other different embodiments and its several details are capable of modifications in various obvious aspects all without departing from the scope of the invention. Accordingly, the drawing and descriptions will be regarded as illustrative in nature and not as restrictive.

BRIEF DESCRIPTION OF THE DRAWINGS

Various exemplary embodiments of this invention will be described in detail, wherein like reference numerals refer to identical or similar components, with reference to the following figures, wherein.

DETAILED DESCRIPTION OF THE PREFERRED EMBODIMENT

Figure 1:
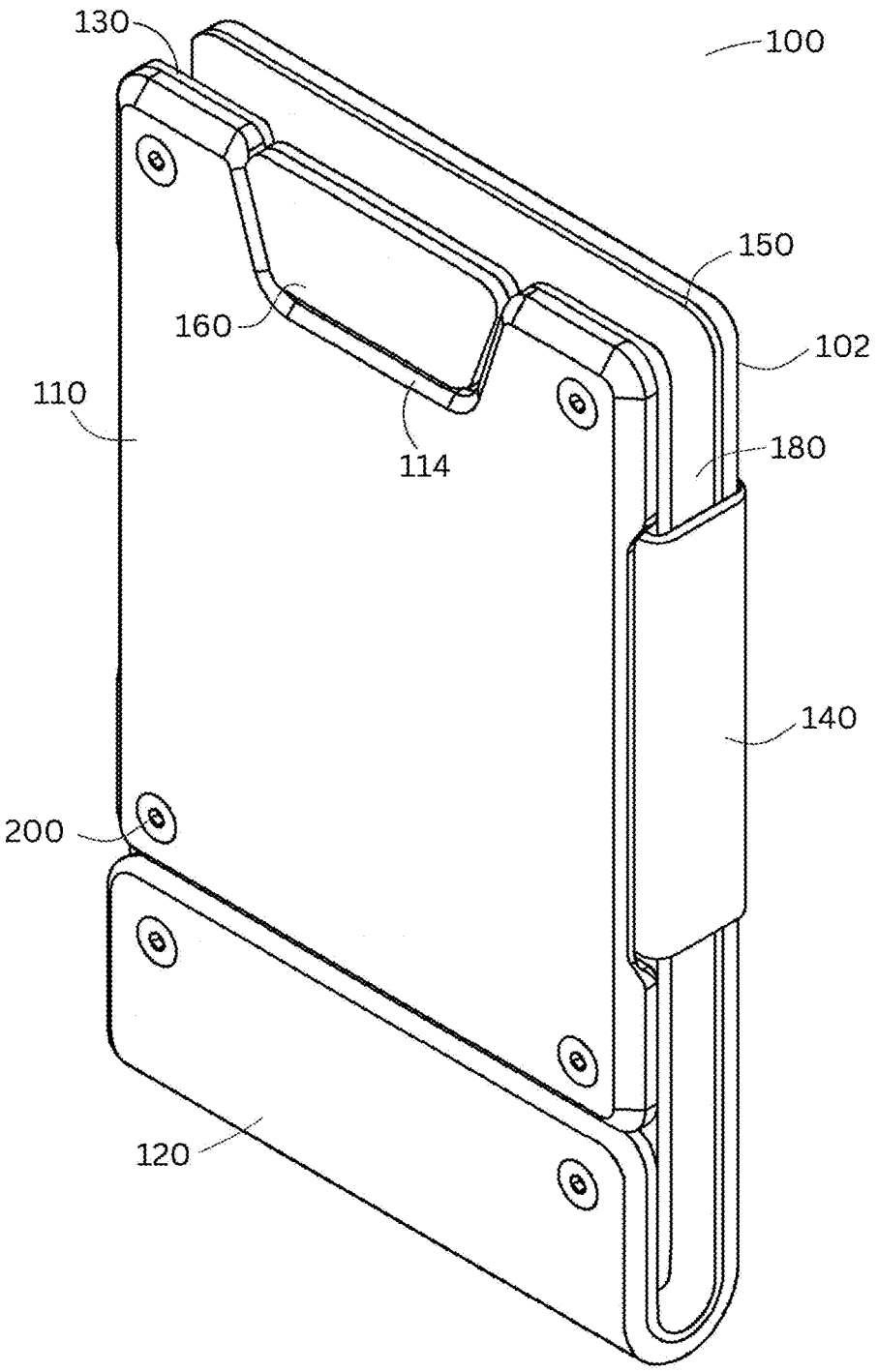
FIG. 1 is a perspective view of the card wallet in accordance with an embodiment of the present invention.
Figure 2:
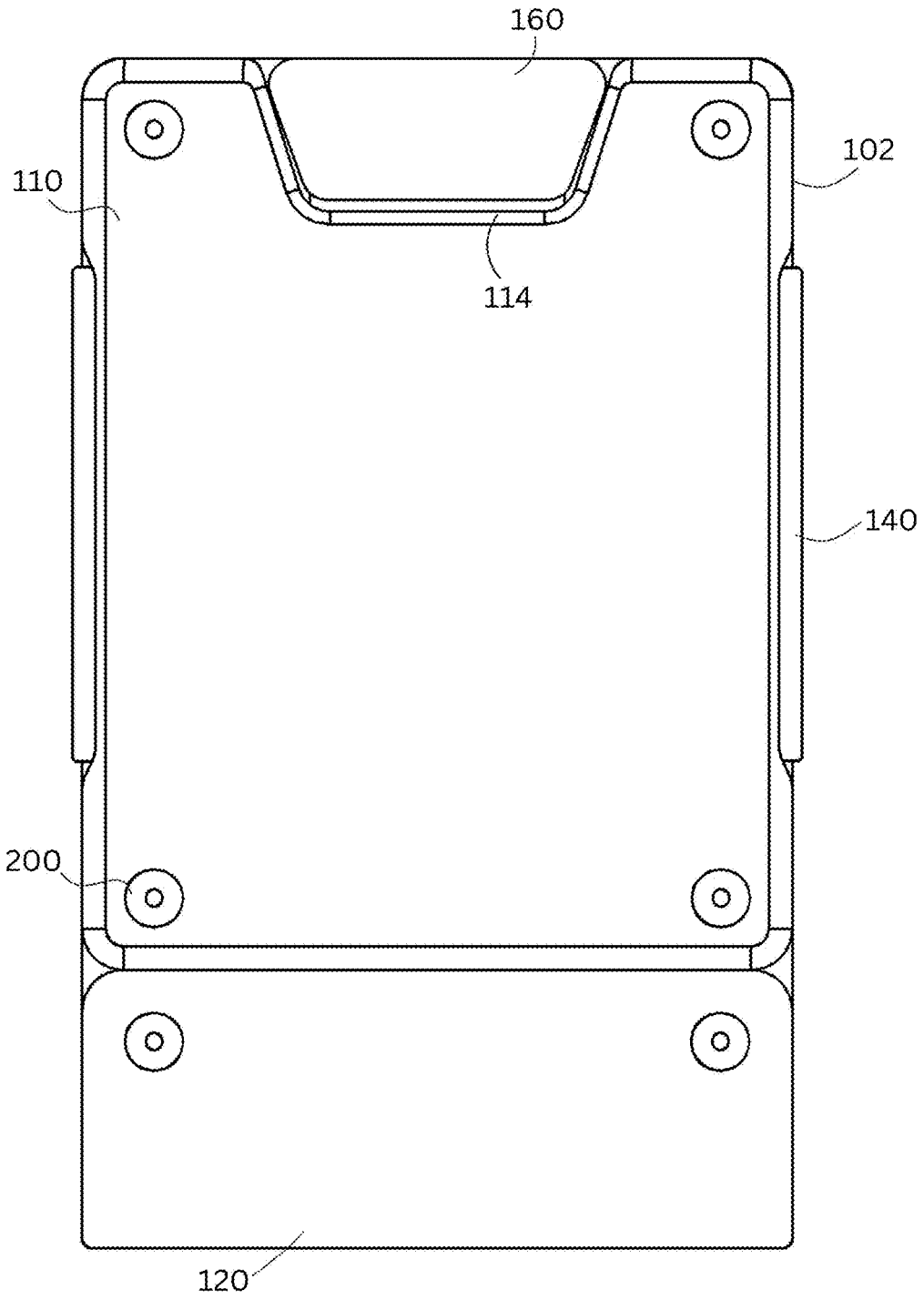
FIG. 2 is a front view of the card wallet.
Figure 3:
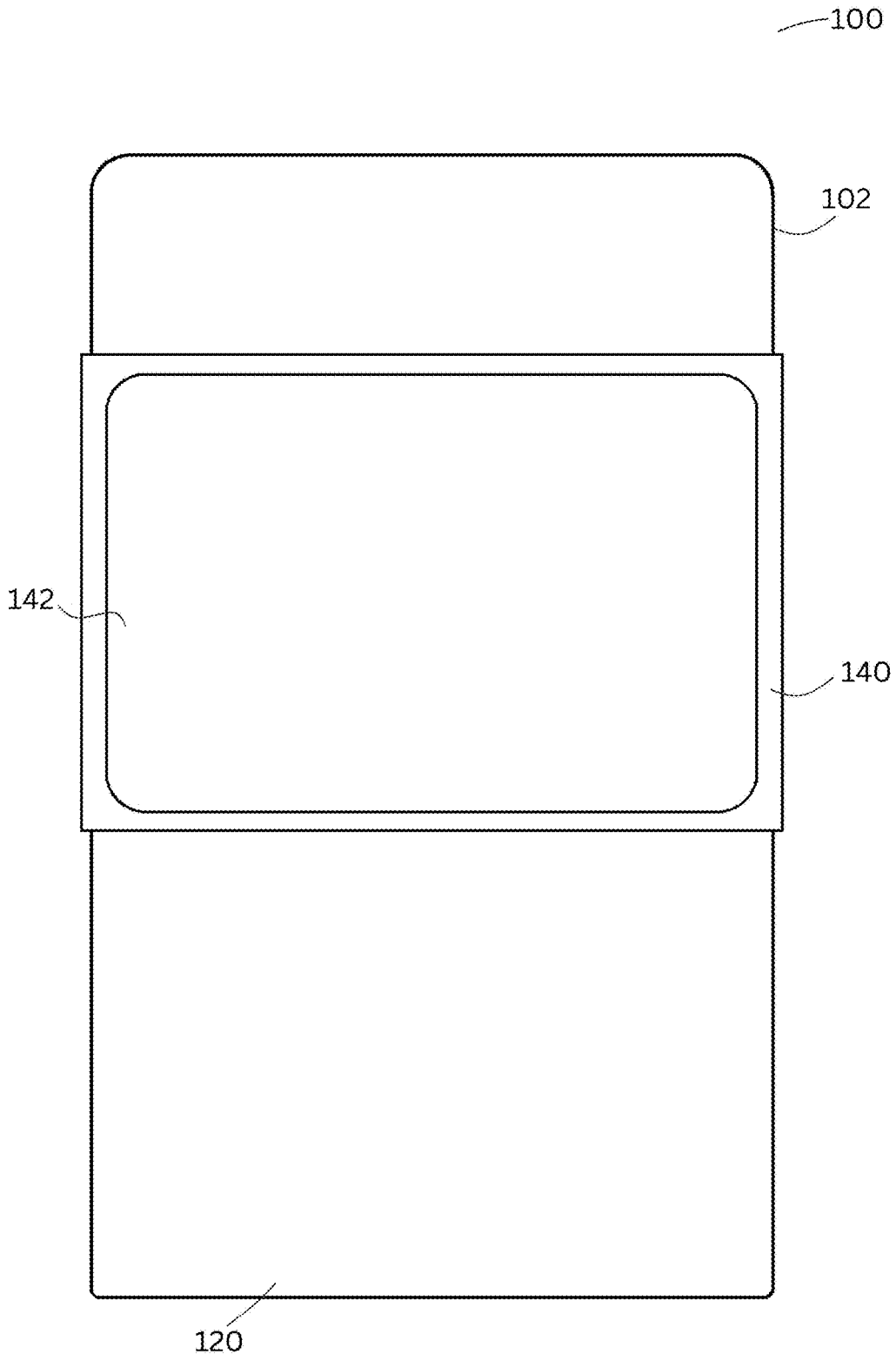
FIG. 3 is a back view of the card wallet.
Figure 4:
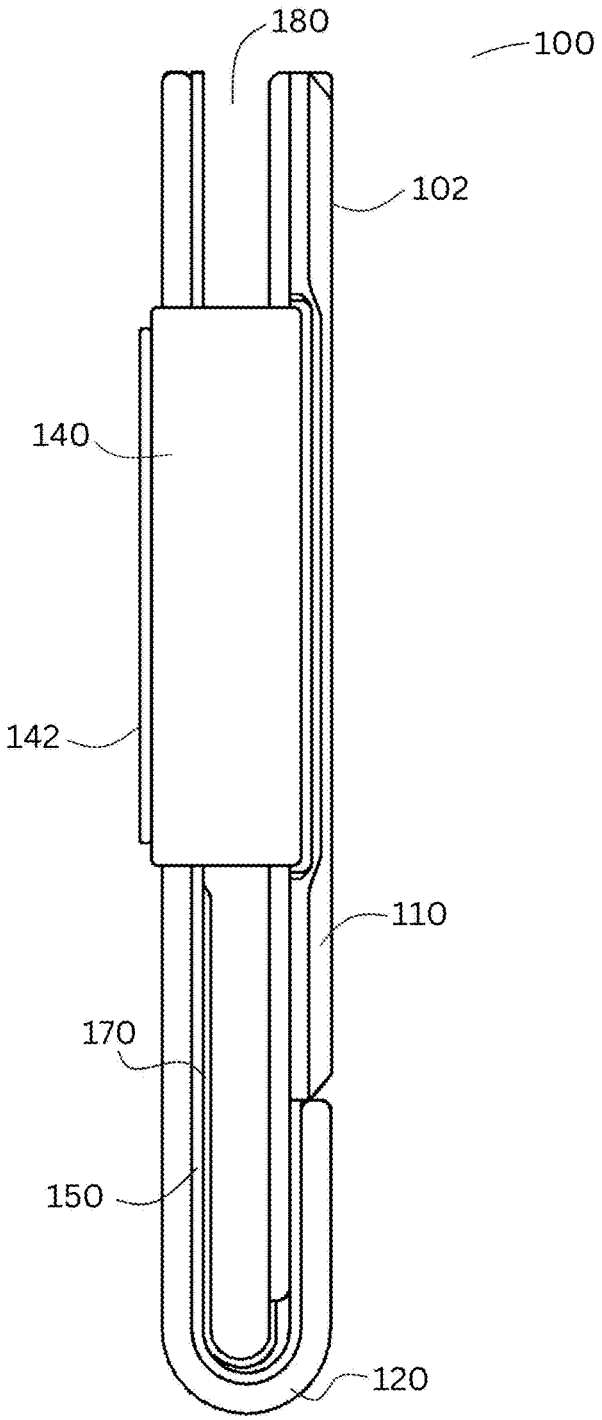
FIG. 4 is a left side view of the card wallet.
Figure 5:
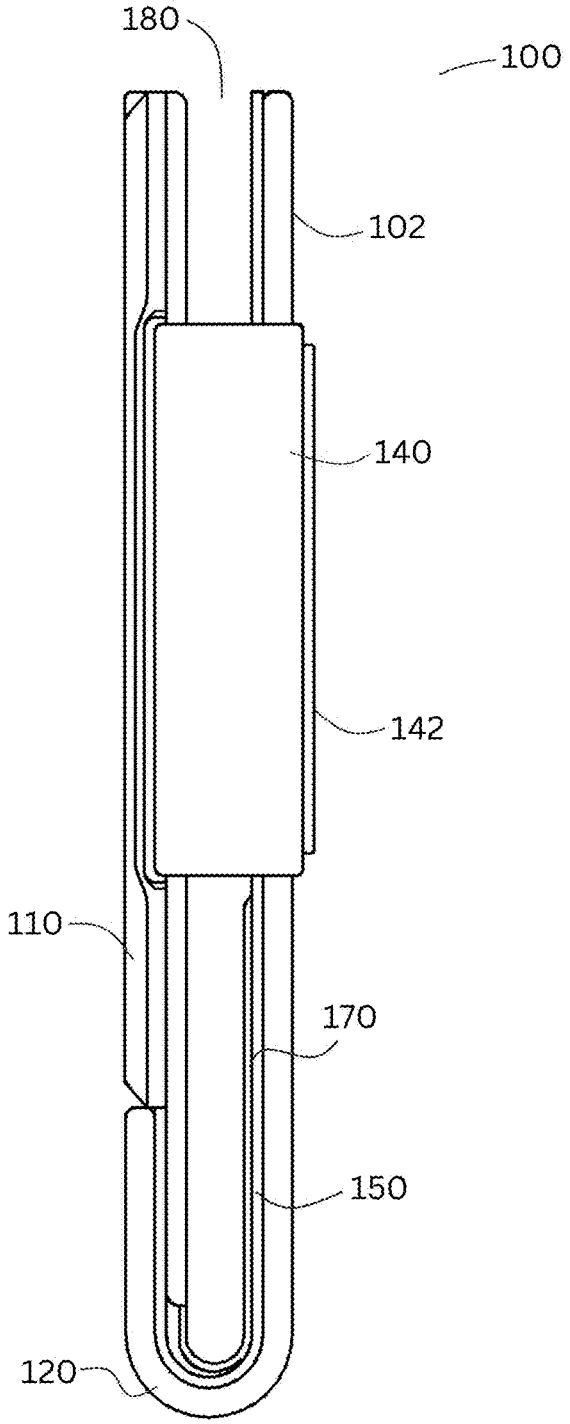
FIG. 5 is a right side view of the card wallet.
Figure 6:
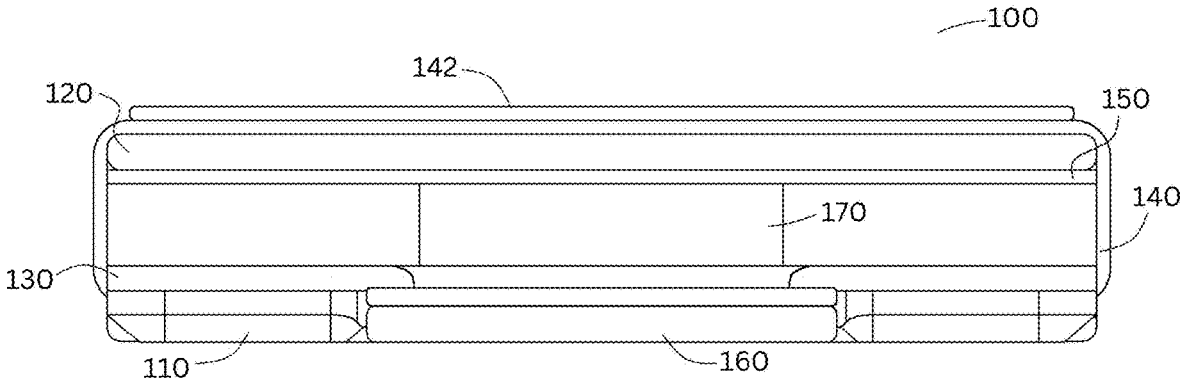
FIG. 6 is a top view of the card wallet.
Figure 7:
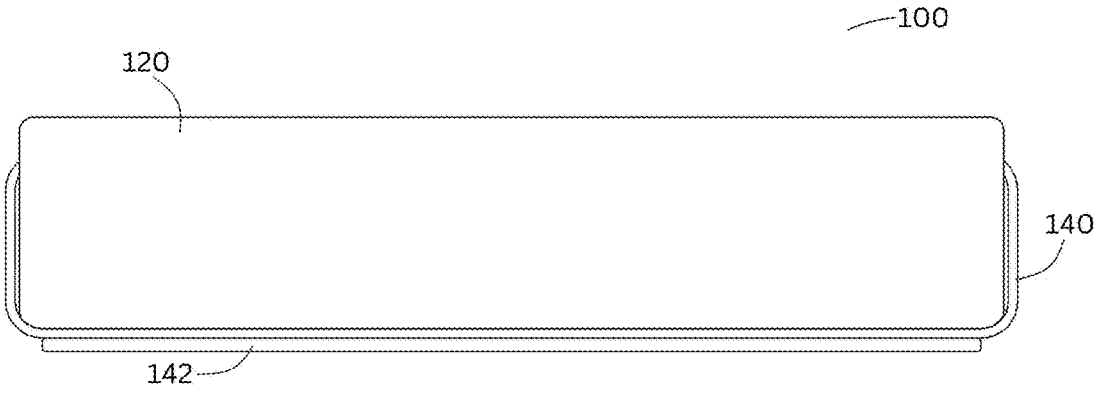
FIG. 7 is a bottom view of the card wallet.

The claimed subject matter is now described with reference to the drawings. In the following description, for purposes of explanation, numerous specific details are set forth in order to provide a thorough understanding of the claimed subject matter. It may be evident, however, that the claimed subject matter may be practiced with or without any combination of these specific details, without departing from the spirit and scope of this invention and the claims.

Referring to FIGS. 1-7 is a card wallet 100 comprising a front metal plate 110, outer panel 120, and elastic band 140 removably secured to a backing plate 130 by screws 200. The card wallet 100 may be any size or shape and made from any materials. The card wallet 100 may hold one or more than one card-like contents 190 in the card compartment 180 and the profile 102 may be sized significantly similar to the width and length dimensions of a credit card. In the preferred embodiment the profile 102 of the card wallet 100 comprises the front metal plate 110 and the outer panel 120 and is sized similarly in width and slightly greater in length to the dimensions of a standard sized credit card. The upper and side portions of the card wallet 100 may align flush with the card-like contents 190 when inserted in the card compartment 180. The card wallet 100 may hold any number and any type of card-like contents 190 such as membership cards, gift cards, IDs, driver's licenses, insurance and prescription cards, and key cards. In the preferred embodiment the card compartment 180 of the card wallet 100 may hold up to twenty-five card-like contents 190.

The front metal plate 110 may be a single plate or a combination of any number of plates. The front metal plate 110 may be made from aluminum, lead, steel, or any other metal or metal alloy and may be ferrous or non-ferrous. The front metal plate 110 may be of any thickness. In the preferred embodiment, the front metal plate 110 is a combination of two plates and is comprised of 6061 aluminum alloy. The front metal plate 110 may be a Radio Frequency Identification (RFID) blocker to prevent skimming of information off cards having RFID chips. The front metal plate 110 may be any size or shape and may have countersunk holes 112 to allow screws 200 or fasteners to pass and seat within. The front metal plate 110 may have a beveled or chamfered edge along the entirety of the perimeter. The beveled edge may be formed at any angle. The countersinking of the countersunk holes 112 and beveled edges of the front metal plate 110 may provide a smooth outer surface thereby allowing a snag-free glide into pockets or other carrying accessories. The front metal plate 110 may be removably secured and replaced with alternative plates of any design.

The outer panel 120 may be any size, shape, or thickness and may be comprised of any number of materials. The outer panel 120 may be made from leather, metal, carbon fiber, or any other material or combination of materials. In the preferred embodiment the outer panel 120 is J-shaped with an outer portion made from leather and more specifically top grain cow hide. In another embodiment the outer panel 120 is J-shaped with an outer portion made from carbon fiber. The soft leather or carbon fiber outer portion and the counter-sinking of the countersunk holes 112 for screws 200 of the outer panel 120 may also help to prevent holes or snags in pockets or other carrying accessories. The outer panel 120 may have an inner layer comprising any number of layers or materials. The inner layer of the outer panel 120 may comprise aluminum, lead, steel, or any other metal or metal alloy and may be ferrous or non-ferrous and may be of any size and thickness. In the preferred embodiment the inner layer of the outer panel 120 is comprised of a thin 6061 aluminum alloy layer sandwiched between two layers of archival paper for durability. The outer panel 120 may have RFID blocking capabilities.

The backing plate 130 may be any size, shape, or thickness and may be made from aluminum, lead, steel, or any other metal or metal alloy. In the preferred embodiment the backing plate 130 is comprised of 6061 aluminum alloy and sized similar to the width and length dimensions of a credit card. The backing plate 130 may have RFID blocking capabilities. The catch bar 134 of the backing plate 130 may be designed to guide and stop the pull strap 170 when the pull tab 160 is lifted. Conversely, the catch bar 134 may stop the pull tab 160 when the pull strap 170 is forced downward. The backing plate 130 may have a beveled edge at the top portion abutting the card-like contents 190 in the card compartment 180. The beveled edge may be formed at any angle and may create a smooth surface area to slide a first proximal card-contents 190 in the card compartment 180.

One portion of the elastic band 140 may be interposed between the front metal plate 110 and backing plate 130. The remaining portion of the elastic band 140 may encircle the backing plate 130 and outer panel 120. The elastic band 140 may allow for the expansion of the card compartment 180 between the backing plate 130 and outer panel 120 when additional card-like contents 190 are inserted. The elastic band 140 may hold the card-like contents 190 securely by means of compression where the introduction of additional card-like contents 190 may increase the pressure of compression. The elastic band 140 may be any size or shape and may be made from elastane, spandex, nylon, polyester, rubber, or any other elastomeric material, or any combination of any elastic materials. In the preferred embodiment the elastic band 140 is comprised of a combination of polyester and rubber.

Figure 8:
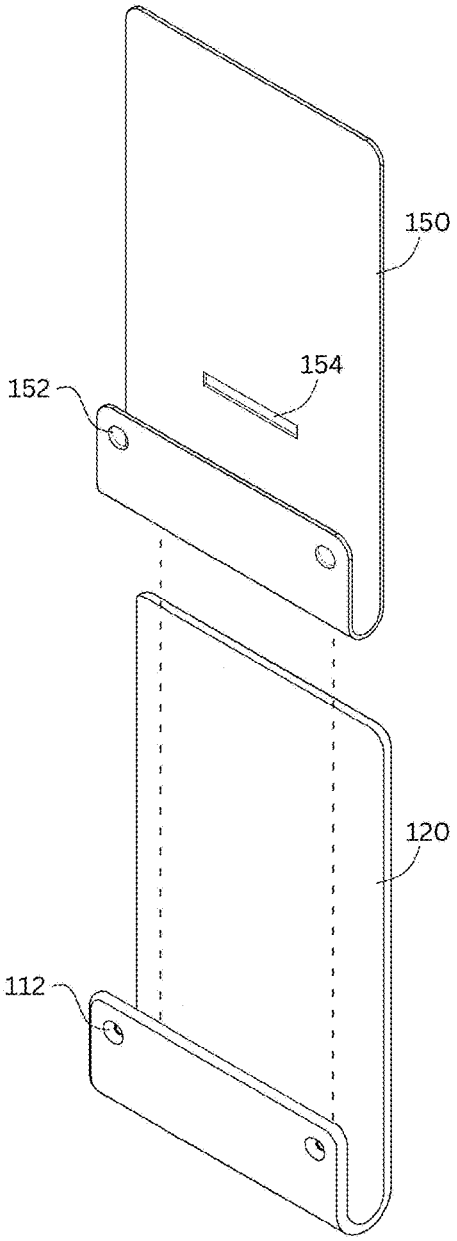
FIG. 8 is a perspective view of the felt liner and outer panel.

Referring to FIG. 8 the felt liner 150 shares an abutting surface with the inner portion of the outer panel 120. The felt liner 150 may be made from wool, polyester, acrylic, or any other material, or a combination of any materials. The felt liner 150 may provide a soft, smooth surface for safe keeping of any portion of the proximal and distal card-like contents 190. The felt liner 150 may be secured to the inner portion of the outer panel 120 by contact adhesive, edge stitching, saddle stitching, or any other known means of attachment. The felt liner 150 may be "J" shaped or any shape. In the preferred embodiment the felt liner 150 is "J" shaped.

Figure 9:
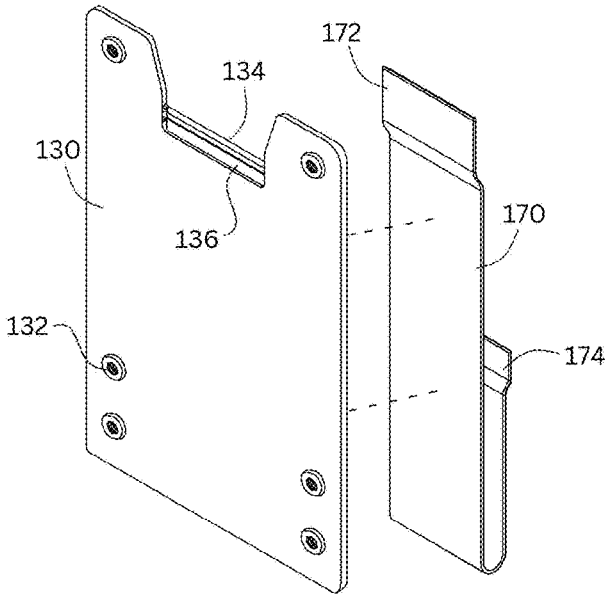
FIG. 9 is a perspective view of the backing plate and pull strap.

Referring to FIG. 9 the backing plate 130 may have one or more than one tapped holes 132. Each tapped hole 132 may be raised from the flat, front surface of the backing plate 130 and may be any size or shape. In the preferred embodiment the tapped hole 132 is round and raised from the surface of the backing plate 130. The first strap portion 172 of the pull strap 170 may feed through the strap slot 136. The rear side of the backing plate 130 may have a latitudinal groove of ample dimension to receive the pull strap 170 and allow it to slide upwards and downwards as the card-like contents 190 are removed and added to the card wallet 100. The second strap portion 174 of the pull strap 170 may feed through the felt slot 154 of the felt liner 150. The second strap portion 174 may share an abutting surface with the inner surface of the outer panel 120 and may be interposed within the felt liner 150 and outer panel 120. The second strap portion 174 may be permanently affixed to the inner surface of the outer panel 120 by contact adhesive, edge stitching, saddle stitching, or any other known means of attachment. The pull strap 170 may be made from nylon, polyester, polypropylene, or any other material or combination of materials. In the preferred embodiment the pull strap 170 is comprised of polyester.

Figure 10:
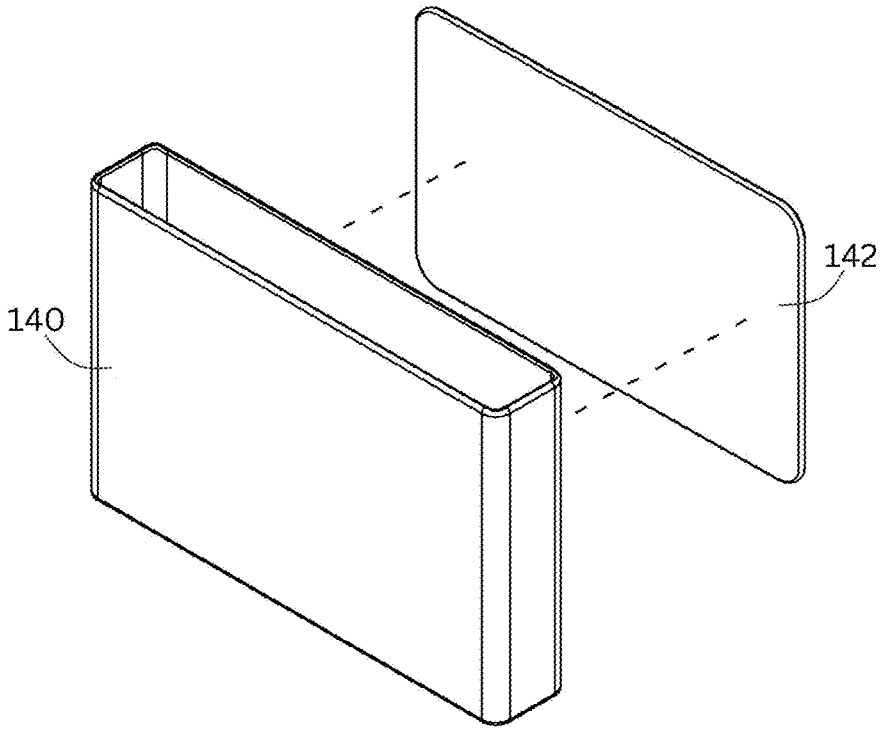
FIG. 10 is a perspective view of the elastic band and band patch.

Referring to FIG. 10 the band patch 142 may be permanently secured to the elastic band 140 with contact adhesive, edge stitching, saddle stitching, or any other means of attachment. The band patch 142 may be made of leather, metal, carbon fiber, or any other material or combination of materials. In the preferred embodiment the band patch 142 is comprised of leather. In another embodiment the band patch 142 is comprised of carbon fiber.

Figure 11:
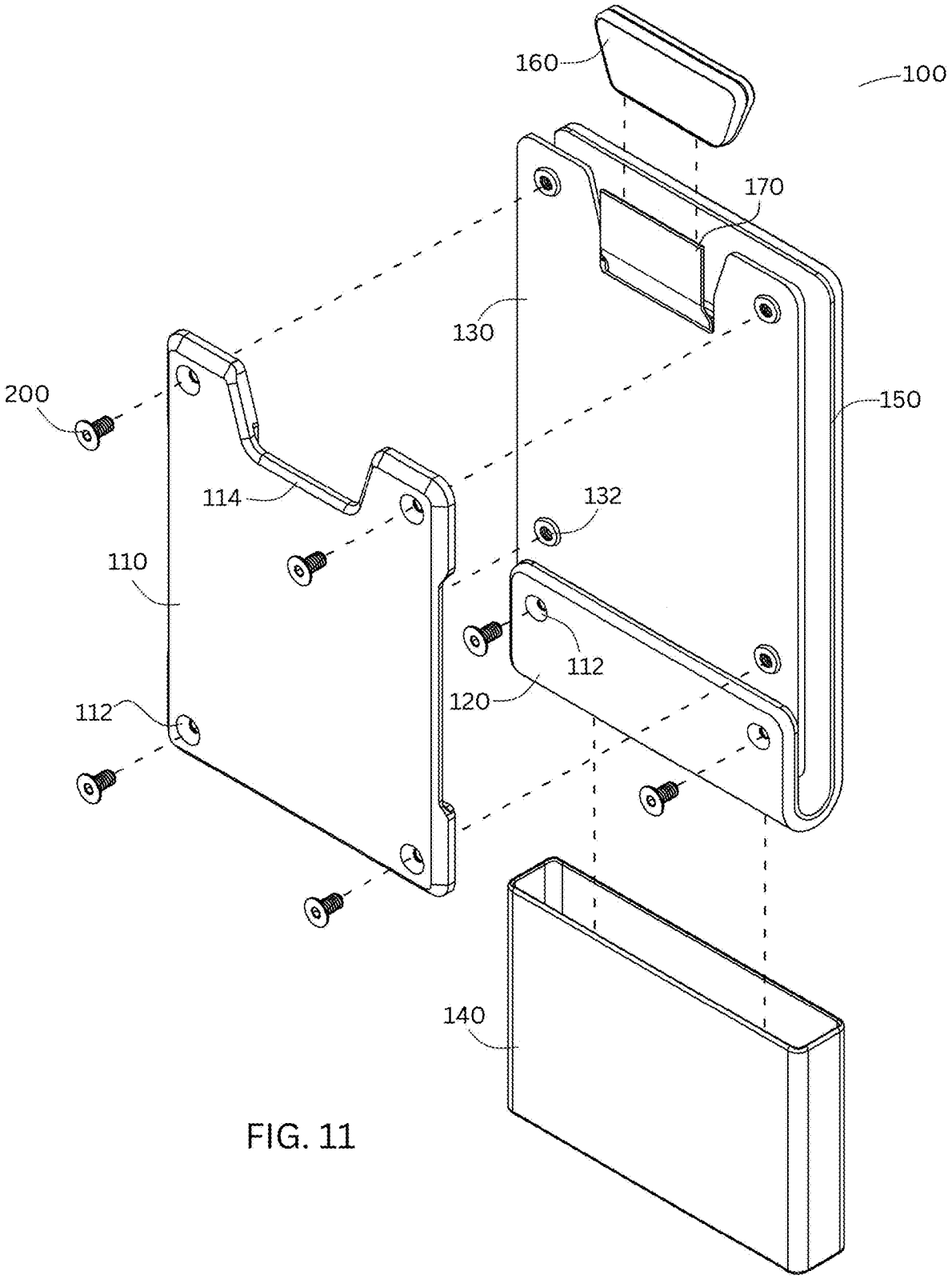
FIG. 11 is an exploded view of the card wallet.

Referring to FIG. 11 the front metal plate 110 may be removably secured with screws 200 that may pass through the countersunk holes 112 and may thread in the tapped holes 132 of the backing plate 130. A front lower portion of the backing plate 130 shares an abutting surface with a lower portion the felt liner 150. The raised portion of the tapped hole 132 may have an alignment such that the raised portion perfectly seats within the thickness and dimensions of the clearance holes 152 of the felt liner 150. The outer panel 120 may be removably secured with screws 200 that may pass through the countersunk holes 112 and may thread in the tapped holes 132 of the backing plate 130. The female threads of the tapped holes 132 are designed to accept the male threads of the screws 200. One front outer portion of the elastic band 140 may share an abutting surface with a portion of the rear surface of the front metal plate 110. One front inner portion of the elastic band 140 may share an abutting surface with a portion of the front surface of the backing plate 130.

The screws 200 may be any size or shape. The screws 200 may have any driver such as slotted, crosshead, square, triangle, any polygonal shape, or any other shape. The screws 200 may have any screw head such as flat, oval, binding, round, or any other shape. In the preferred embodiment the heads of the screws 200 are flat with a hexagonal driver that may countersink into the countersunk holes 112 of the front metal plate 110 and outer panel 120 to achieve a flat front surface of the card wallet 100. Any or all of the components of the card wallet 100 may be removably secured by the screws 200 for easy cleaning or replacement of said components. The card wallet 100 may be provided at retail in configuration with a tool, such as a driver or a hex key to assist with assembly or disassembly.

The pull tab 160 may be any size or shape and may be permanently secured to the first strap portion 172 of the pull strap 170. The pull tab 160 may be made of leather, polyester, carbon fiber, or any other material or combination of materials. In the preferred embodiment the pull tab 160 is comprised of leather. In another embodiment the pull tab 160 is comprised of carbon fiber. The pull tab 160 may be secured to the first strap portion 172 by contact adhesive, edge stitching, saddle stitching, or any other known means of attachment. The pull tab 160 may be comprised of two half portions or any number of portions that encase the first strap portion 172.

Figure 12:
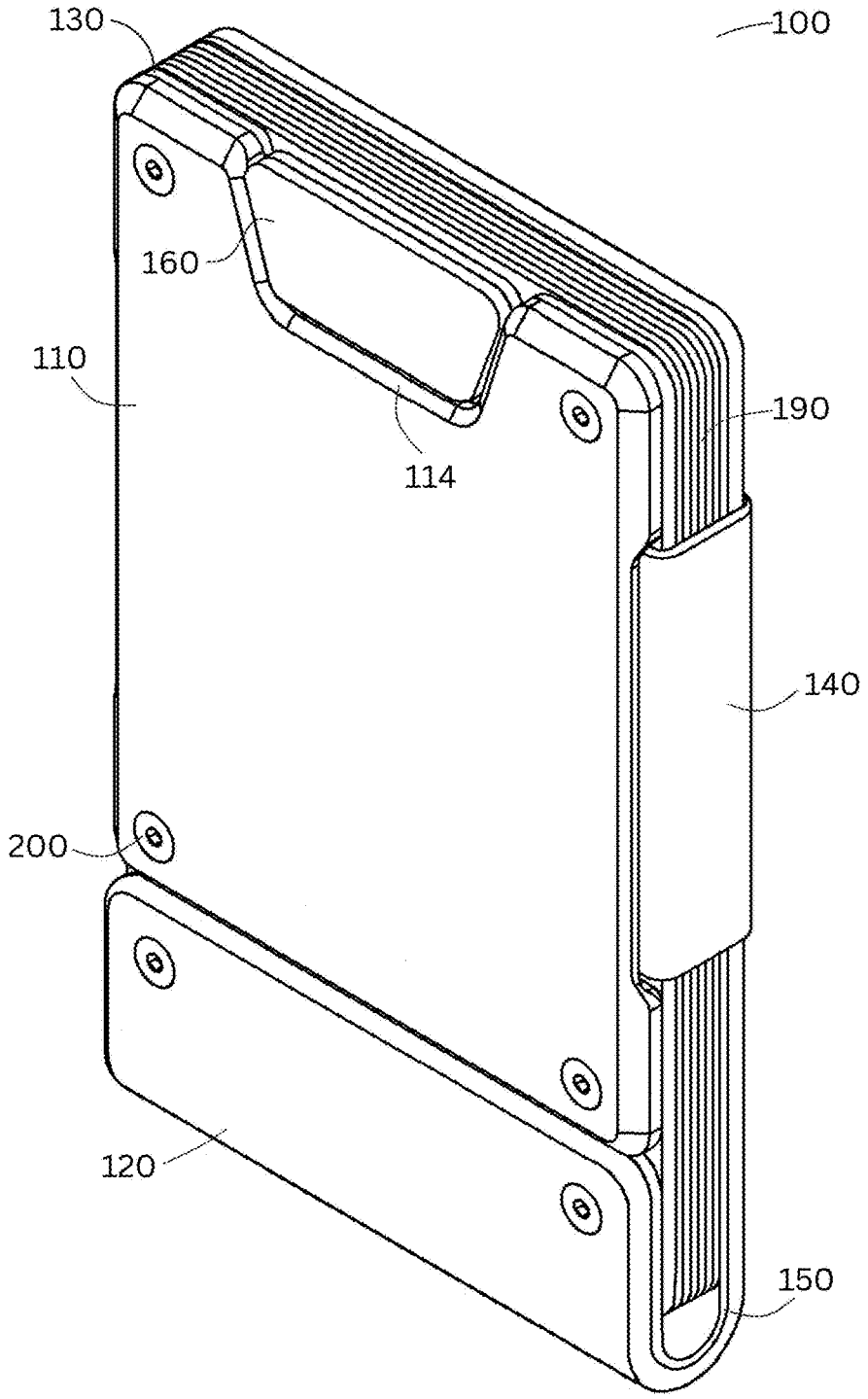
FIG. 12 is a perspective view of the card wallet with card-like contents.
Figure 13:
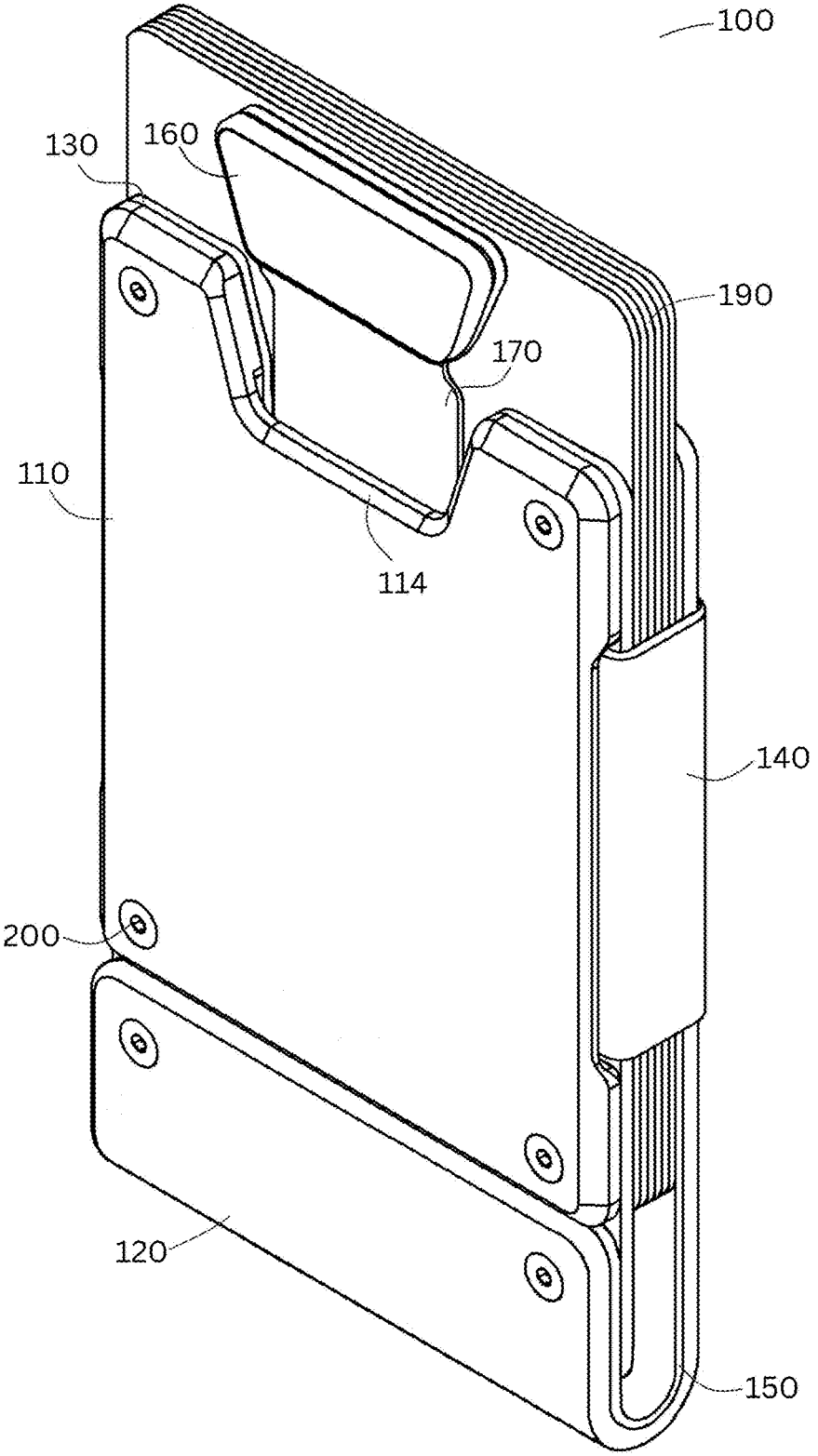
FIG. 13 is another perspective view of the card wallet with card-like contents.

Referring to FIGS. 12-13 the pull tab 160 may rest in a recessed portion 114 of the front metal plate 110 when not in use, allowing the overall exterior profile 102 of the card wallet 100 to remain flat for comfortable carrying while lessening wear to the pull tab 160 and pull strap 170. The recessed area 114 may be designed of similar dimensions to various portions of the pull tab 160 and may share any number of abutting edges when not in use. The pull strap 170 may share abutting surfaces anywhere on any or all of the card-like contents 190. Any outward action applied to the pull tab 160 or the pull strap 170 may result in the card-like contents 190 being ejected and any inward action applied to the pull tab 160 or the pull strap 170 may result in the card-like contents 190 being seated. When a user grasps the pull tab 160 and pulls outward from the card wallet 100, tension may be applied to the pull strap 170 and the card-like contents 190 may be ejected for selection. After a user has completed an activity with any of the card-like contents 190 removed from the card wallet 100, they may be inserted back to the card compartment 180 of the card wallet 100 inwardly until the pull tab 160 is stopped by the catch bar 136 of the backing plate 130.

The elasticity of the elastic band 140 and the pliability of the materials of the outer panel 120 may allow for maximal amounts of card-like contents 190. The elastic band 140 holds the card-like contents 190 securely by means of compression, while also expanding elastically to open space between the backing plate 130 and the outer panel 120. The card wallet 100 may also be designed to hold paper money or other contents between the elastic band 140 and the outer panel 120. The paper money may be held securely by means of compression from the elastic band 140 encircling the backing plate 130 and outer panel 120.

In an alternative embodiment the front metal plate 110 may have one or more than one magnet embedded in the surface to magnetically attach to certain types of cellular phones or cases for cellular phones. The magnets may be secured to the front metal plate 110 by any method of adhesion. The magnets may also magnetically attach to any other objects having magnetic properties. The magnets may be designed to be MagSafe® compatible and may be located anywhere on the front metal plate 110 in any arrangement.

In another embodiment the card wallet 100 may be provided at retail in configuration with an AirTag® accessory holder that may attach to the elastic band 140 or band patch 142. An Apple® AirTag® is a small, button-sized tracking device designed to allow a user to locate and keep track of personal items such as keys, wallets, bags, and other objects. An AirTag® uses Bluetooth Low Energy (BLE) technology to communicate with nearby Apple devices. When an AirTag is within Bluetooth range of a user's iPhone®, iPad®, or Mac®, it connects and sends its location to a user's device through the Find My® application.

If a card wallet 100 with an AirTag® is out of Bluetooth range, it may still be located using the Find My® network through crowdsourcing which includes millions of Apple® devices. When the card wallet 100 with AirTag® is lost, it may send a secure Bluetooth signal that can be detected by any nearby Apple® device. That device may anonymously transmit the AirTag® location to iCloud®, where a user may be able to see it on a map in the Find My® application. If the card wallet 100 is lost with an AirTag® attached, the user may also put it into "Lost Mode" via the Find My® application. In "Lost Mode," the AirTag® will automatically notify a user when it's detected by any device on the Find My® network. A user may choose to share their contact information so that someone who finds the card wallet 100 can contact make contact by tapping the AirTag® with their phone.

In another embodiment the band patch 142 or elastic band 140 may have a compartment that may hold the AirTag® securely. The compartment may be a cutout on the band patch 142 or a holder that may be securely attached by any means to the band patch 142 or elastic band 140. In still another embodiment the card wallet 100 may be provided at retail in configuration with an AirTag® card holder that may measure similar width and length dimensions of a standard credit card with similar dimensions of depth to that of an AirTag®. The card may have a compartment to store an AirTag® and may be made of any materials in any size or shape. The card may have additional compartments for storage and may have any additional uses and benefits. The card may fit securely within the card compartment 180 of the card wallet 100.

What has been described above includes examples of the claimed subject matter. It is, of course, not possible to describe every conceivable combination of components or methodologies for purposes of describing the claimed subject matter, but one of ordinary skill in the art can recognize that many further combinations and permutations of such matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

The preceding description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the following claims and the principles and novel features disclosed herein.

The invention claimed is:

1. A card wallet comprising:

(a) a front metal plate having a bottom end and a top end;

(b) a backing plate having a bottom end and a top end, wherein said backing plate is disposed adjacent to said front metal plate;

(c) a shaped outer panel having a first end, a second end distal from said first end, and a first portion, wherein said first portion is disposed substantially parallel to said front metal plate to form a card compartment;

(d) wherein said first end of said shaped outer panel is connected to a bottom end of said backing plate;

(e) wherein said second end of said shaped outer panel is disposed at a top end of said card wallet;

(f) wherein said top end of said front metal plate is disposed at said top end of said card wallet;

(g) wherein said top end of said backing plate is disposed at said top end of said card wallet;

(h) an elastic band interposed between said front metal plate and said backing plate and encircling said backing plate and said shaped outer panel;

(i) a pull strap attached to an inner portion of said shaped outer panel and extending along said backing plate to said top end of said card wallet.

2. The card wallet as in claim 1 wherein said front metal plate is removably secured to said backing plate by one or more screws.

3. The card wallet as in claim 1 wherein said shaped outer panel is removably secured to said bottom end of said backing plate by one or more screws.

4. The card wallet as in claim 1 wherein said front metal plate further comprises one or more countersunk holes; and wherein said shaped outer panel further comprises one or more countersunk holes located at first end of said shaped outer panel.

5. The card wallet as in claim 1 wherein said backing plate further comprises one or more tapped holes.

6. The card wallet as in claim 1 wherein said backing plate further comprises a catch bar and strap slot disposed at said top end.

7. The card wallet as in claim 6 wherein a first portion of said pull strap is fed through said strap slot of said backing plate; wherein said pull strap is disposed in said strap slot.

8. The card wallet as in claim 7 further comprising a pull tab attached to an end of said pull strap.

9. The card wallet as in claim 1 further comprising a felt liner attached to an inner portion of said shaped outer panel.

10. The card wallet as in claim 9 further comprising a felt slot disposed on said felt liner.

11. The card wallet as in claim 1 wherein a portion of said pull strap passes through said felt slot of said felt liner.

12. The card wallet as in claim 1 wherein said front metal plate is comprised of 6061 Aluminum.

13. The card wallet as in claim 12 wherein said front metal plate further comprises a beveled edge.

14. The card wallet as in claim 1 wherein said shaped outer panel is comprised of leather.

15. The card wallet as in claim 14 wherein said shaped outer panel is comprised of carbon fiber.

16. The card wallet as in claim 1 wherein said backing plate is comprised of 6061 Aluminum.

17. The card wallet as in claim 1 further comprising a band patch attached to said elastic band.

18. The card wallet as in claim 1 wherein said elastic band is comprised of polyester and rubber.

19. The card wallet as in claim 1 wherein each of the said backing plate, said shaped outer panel, and said front metal plate have RFID blocking capabilities.

20. The card wallet as in claim 19 further comprising (a) a pull tab attached to an end of said pull strap;

(b) a felt liner attached to an inner portion of said shaped outer panel, wherein said felt liner has a felt slot;

(c) a band patch attached to said elastic band;

(d) wherein said front metal plate is removably secured to said backing plate by one or more screws;

(e) wherein said shaped outer panel is removably secured to said bottom end of said backing plate by one or more screws;

(f) wherein said front metal plate further comprises one or more countersunk holes; and wherein said shaped outer panel further comprises one or more countersunk holes located at first end of said shaped outer panel;

(g) wherein said backing plate further comprises one or more tapped holes;

(h) wherein said backing plate further comprising a catch bar and strap slot disposed at said top end;

(i) wherein a first portion of said pull strap is fed through said strap slot of said backing plate; wherein said pull strap is disposed in said strap slot;

(j) wherein a portion of said pull strap passes through said felt slot of said felt liner; and (k) wherein said front metal plate further comprises a beveled edge.

* * * * *